United States Patent [19]

Salibi

[11] Patent Number: 5,068,925

[45] Date of Patent: Dec. 3, 1991

[54] FOOT FLUSH ADAPTOR

[76] Inventor: S. Kamal Salibi, 6273 Kipap Rd., Kapaa, Hi. 96746

[21] Appl. No.: 585,810

[22] Filed: Sep. 19, 1990

[51] Int. Cl.[5] ..... E03D 5/08

[52] U.S. Cl. ..... 4/249; 4/405; 403/161; 403/237; 403/271

[58] Field of Search ..... 4/249, 308, 405, 251, 4/250; 403/161, 162, 163, 237, 271

[56] References Cited

U.S. PATENT DOCUMENTS

| | | | |
|---|---|---|---|
| 1,614,346 | 1/1927 | Coret | 4/249 |
| 1,963,981 | 6/1934 | Garrett | 403/237 X |
| 2,929,073 | 3/1960 | Sarlin | 4/249 X |
| 3,624,845 | 12/1971 | Vorgang | 4/249 |

FOREIGN PATENT DOCUMENTS

| | | | |
|---|---|---|---|
| 360241 | 3/1962 | Switzerland | 403/162 |

*Primary Examiner*—Charles E. Phillips
*Attorney, Agent, or Firm*—Price, Gess & Ubell

[57] ABSTRACT

An apparatus that adapts hand actuated flushing mechanisms, commonly found on commercial latrines, for actuation using one's foot. An extension tubing couples to an actuation mechanism of a flushing mechanism, for causing actuation of the flushing mechanism. A connecting rod member couples to the extension tubing for causing the extension tubing to actuate the flushing mechanism. A foot pedal couples to the connecting rod member to oscillate the connecting rod member. A mounting bracket couples to the foot pedal for pivotally mounting the foot pedal to a remote surface for pivotal movement of the foot pedal.

15 Claims, 2 Drawing Sheets

FOOT FLUSH ADAPTOR

BACKGROUND OF THE INVENTION

1. Field of the Invention

The subject of the present invention relates generally to commercial plumbing fixtures and, more particularly, to an apparatus that adapts hand actuated latrine flushing mechanisms for actuation using one's foot.

2. Description of Related Art

Commercial urinal and toilet flushing mechanisms are conventionally designed as either foot actuated or hand actuated. If an existing hand actuated flushing mechanism in either a urinal or toilet is desired to be converted to foot actuation, this process can be very costly. It may typically involve replacing plumbing fixtures, such as toilets or urinals, with plumbing fixtures that are compatible with foot flush mechanisms, and replacing the hardware associated with installation of these fixtures. It may also involve minor carpentry depending upon necessary changes in location of sewer and water hookups. As can be appreciated, there exists a need for a time and cost efficient flushing mechanism conversion apparatus.

SUMMARY OF THE INVENTION

It is therefore an object of the invention to provide an apparatus for adapting a hand actuation means of a latrine flushing mechanism;

It is another objective of the invention to improve flushing mechanism conversion apparatus; and It is another objective of the invention to provide an improved means of converting hand actuated flushing mechanisms to foot actuated.

These and other objects and advantages are achieved according to the present invention by attaching an apparatus to an actuation means of a flushing mechanism and mounting an opposite end thereof to a surface remotely located with respect to the actuation means.

An adaptor means couples to an actuation means for causing actuation thereof; a connecting means couples to the adaptor means for causing the adaptor means to actuate the actuation means; a lever member couples to the connecting means for oscillating the connecting means; and a mounting means couples to the lever member for pivotal mounting thereof to the remotely located surface for pivotal movement of the lever member.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE INVENTION

The following description is provided to enable any person skilled in the flushing mechanism apparatus conversion art to make and use the invention and sets forth the best modes contemplated by the inventor of carrying out his invention. Various modifications, however, will remain readily apparent to those skilled in the art, since the generic principles of the present invention have been defined herein specifically to provide a relatively economical process for manufacturing a latrine flushing mechanism conversion apparatus of an improved structure on a production basis.

Figure 1:
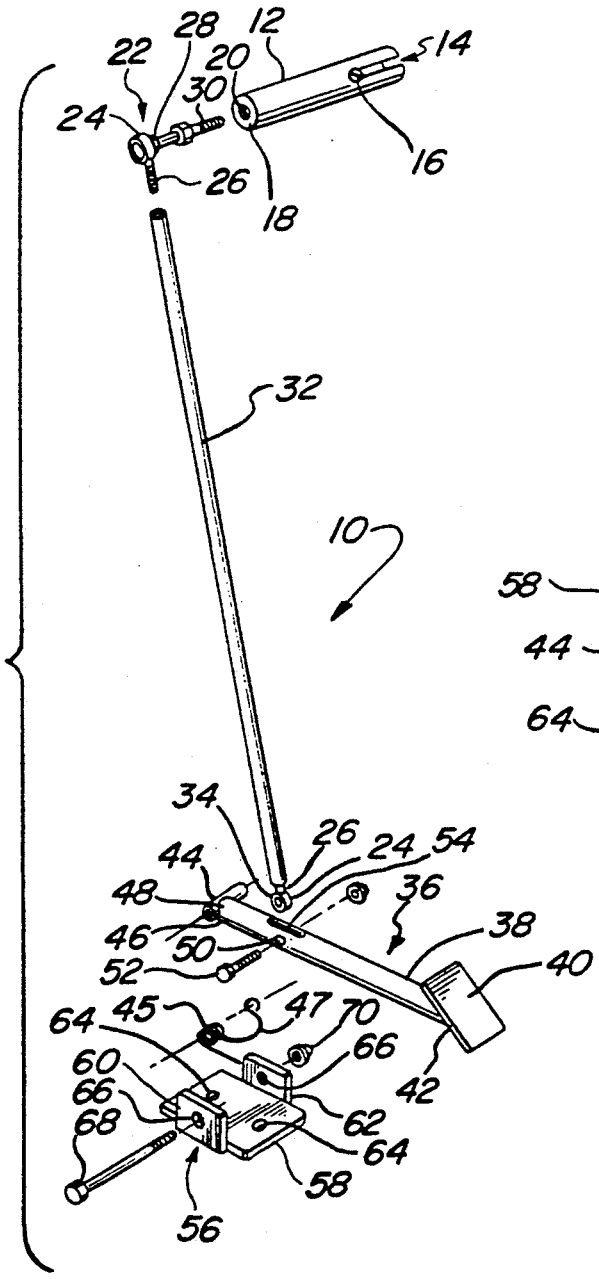
FIG. 1 is an exploded perspective view of the apparatus of the present invention showing elements thereof.

Referring to FIG. 1 of the drawings, there is shown an exploded perspective view of an embodiment of the apparatus 10 of the present invention. The apparatus 10 shown in FIG. 1 is designed for use with a commercial toilet, though its uses are not limited thereto.

A handle extension tubing 12 has a slotted end 14 that slides over a handle of a flushing mechanism (not seen in FIG. 1). The extension tubing 12 may comprise stainless steel, or the like, and have a diameter of substantially ¾ inch, enabling the tubing 12 to slip-fit over the flushing mechanism handle, then secured in place by a tap screw 16. The extension tubing 12 may be 2 3/16 inches long when used with a toilet flushing mechanism apparatus, and 6 inches long, for example, when used with a urinal flushing apparatus. At an opposite end of the tubing 12 there is welded a circular plate 18, having a tapped opening 20 in the center thereof. The tapped opening 20 in the plate 18 enables a joining means 22, such as a ninety degree heim end to be secured therein.

The heim end 22 has an annular end portion 24 having a first threaded bolt portion 26. A rotatable ball bearing 28 having a second threaded bolt portion 30 resides in the annular end portion 24. The second threaded bolt portion 30 of the ball bearing 28 is adapted to screw into the tapped opening 20 of the extension tubing 12.

A substantially straight, hollow connecting rod 32 is tapped on either end. The connecting rod 32 may comprise stainless steel, for example, and be substantially ⅜ inch in diameter. The connecting rod 32 may be, for example, 48 inches long when the apparatus 10 is installed on a urinal (seen in FIGS. 4*a*, 4*b*) or 23 inches long when the apparatus 10 is installed on a toilet (seen in FIG. 5). A straight heim end 34 is shown screwed into a tapped end of the connecting rod 32. The straight heim end 34 comprises a threaded bolt portion 26 and an annular end portion 24. The length of the connecting rod 32 may be varied by adjusting the amount of threaded bolt portion 26 disposed in either tapped end of the connecting rod 32.

A foot pedal 36 comprises a lever member or portion of substantially straight tubing 38, comprised of stainless steel for example, that may be 10 inches long and ¾ inch in diameter. A flat, rectangular plate 40 is affixed, by welding for example, to an end 42 of the tubing 38. The end 42 of the tubing 38 is cut such that when the plate 40 is affixed thereto, it forms an angle of substantially 35 degrees with the tubing 38, to provide ease of operation of the apparatus 10. The plate 40 may be 2 inches long, ¾ inch wide, and ⅛ inch thick, for example.

A portion of small diameter tubing 44, comprising stainless steel, for example, is affixed to the tubing 38 in a pair of diametrically opposed grooves 46, located at a centermost portion of an end 48 of the foot pedal 36. The small diameter tubing 44 is affixed, such that it is parallel to the flat portion of the plate 40 and substantially half the circumference thereof resides in the diametrically opposed grooves 46. The small diameter tubing 44 is affixed in the grooves 46 with the length thereof substantially off-center, to accommodate a coiled end (best seen in FIGS. 2 and 3) of a torsion spring 45. The small diameter tubing 44 may be substantially ¾ inch long and ⅜ inch in diameter, for example. The plate 40 and small diameter tubing 44 may be affixed to the tubing 38 by welding, for example.

A pair of diametrically opposed holes 50 are located at a centermost portion of the tubing 38, approximately 2 ¼ inches from the small diameter tubing 44 and substantially parallel thereto. The holes 50 are preferably round and adapted to have a suitable fastening means 52, such as a bolt or rivet, for example, disposed therethrough. An oblong opening 54 is disposed lengthwise in a topmost portion of the tubing 38 such that the centermost portion thereof is aligned with the holes 50 and the sides thereof are equidistant from either hole 50. The oblong opening 54 is designed to allow the annular portion 24 of the straight heim end 34 to be disposed lengthwise therein.

Once the heim end 34 is placed in the oblong opening 54, the fastening means 52, may be disposed through either hole 50, through the annular end portion 24 of the heim end 34, through the remaining hole 50, and secured in place, to pivotally attach the connecting rod 32 to the foot pedal 36.

A mounting bracket 56 comprises a substantially flat, rectangular mounting plate 58, and a pair of flat, rectangular end plates 60, 62. Each plate 58, 60, 62 may comprise stainless steel, for example. The mounting plate 58 may be 2 inches long, 1 5/16 inches wide, and ⅛ inch thick. The mounting bracket 56 may be attached to a remote surface, by an epoxy glue for example. If the mounting bracket 56 is to be mounted to a remote surface using bolts, or the like, the mounting plate 58 may have an opening 64 disposed in either end region. The end plates 60, 62 may be 1 ¼ inches long, 1 ⅛ inches wide, and ⅛ inch thick, for example. The end plates 60, 62 are attached to the mounting plate 58, by welding for example, at a centermost region of the longest sides thereof. A round opening 66 is disposed in a centermost region of each end plate 60, 62.

The foot pedal 36 is pivotally attached to the mounting bracket 56, by first disposing a fastening means 68, such as a bolt, for example, slightly through an opening 66 in the end plate 60. Ends of the torsion spring 45 (best seen in FIGS. 2 and 3) are then aligned with the opening 66 in either end plate 60, 62. The foot pedal 36 is then placed over an arced portion 47 of the torsion spring 45, with the shorter end of the small diameter tubing 44 proximal to the bolt 68 and aligned with the ends of the torsion spring 45, that is in substantial alignment with the openings 66 in either end plate 60, 62. The bolt 68, which may be 1 ¾ inches long, for example, may then be disposed through a coiled end of the torsion spring 45, through the small diameter tubing 44, through the remaining end of the torsion spring 45, and through the remaining opening 66. The bolt 68 may then be secured in position by a nut 70, for example.

Figure 2:
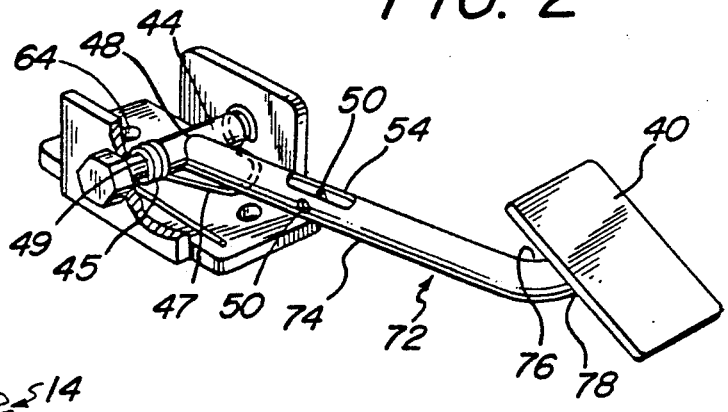
FIG. 2 is a perspective view of an alternative embodiment of a foot pedal of the present invention, pivotally mounted to a mounting bracket.

FIG. 2 of the drawings shows a perspective view of an alterative foot pedal 72. The alternative foot pedal 72 may be used when installing the invented apparatus 10 on a full length or half length commercial urinal, for example. The alternative foot pedal 72 comprises a straight portion of tubing 74 having a curvature 76 located at substantially 5 ½ inches from the end 48 where the small diameter tubing 44 is disposed. The alternative foot pedal 72 may be 8 ¼ inches long, for example, and have a diameter substantially equal to the previous foot pedal 36. The curvature 76 forms a substantially 30 degree angle with the straight portion of tubing 74 and is approximately perpendicular to the small diameter tubing 44.

The oblong opening 54 is disposed lengthwise in a topmost portion of the straight portion of tubing 74, such that the centermost portion thereof is aligned with the holes 50 and the sides thereof are equidistant from either hole 50. The oblong opening may be ¾ inch in length and ⅜ inch in width, for example. The substantially flat, rectangular plate 40 is affixed to an end 78 closest to the curvature 76, such that it forms an angle of substantially 40 degrees with the straight portion of tubing 74 of the foot pedal 72. The coiled end 49 of the torsion spring 45 causes the arced portion 47 thereof to exert an upward force on the bottom of the foot pedal 72, thus maintaining the foot pedal 72 in a upward position, to reduce ware of the actuation means of the flushing mechanism.

Figure 3:
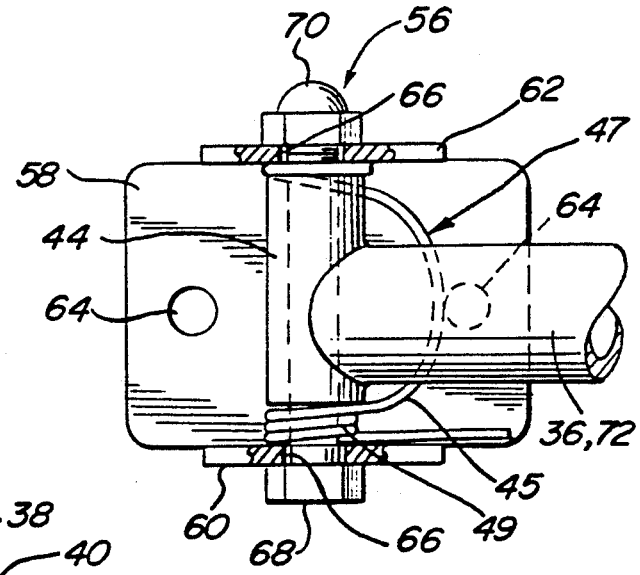
FIG. 3 is a top plan view showing an end of either embodiment of the foot pedal connected to the mounting bracket.

Referring now to FIG. 3, a top plan view of the mounting bracket 56 is shown. The flat, rectangular mounting plate 58 is shown having two round openings 64 where fastening means (not shown) may be disposed through, to attach the mounting bracket 56 to a remote surface. The flat, rectangular end plates 60, 62 affix to the edges of the longest sides of the mounting plate 58. The round openings 66 are disposed in a centermost region of each end plate 60, 62. The bolt 68 passes through the coiled end 49 of the torsion spring 45, through the small diameter tubing 44, through the remaining end of the torsion spring 45, and through the remaining opening 66, thus pivotally attaching either foot pedal 36, 72, to the mounting bracket 56. The bolt 68 is retained in position by the nut 70. The coiled end 49 of the torsion spring 45 causes the arced portion 47 thereof to exert an upward force on the bottom of the desired foot pedal 36, 72, thus maintaining either foot pedal 36, 72 in an upward position.

Figure 4A:
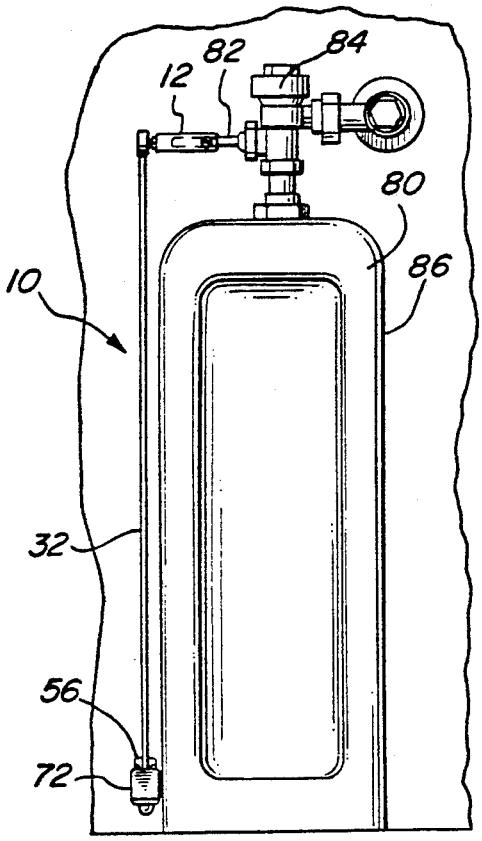
FIGS. 4*a* and 4*b* show a front view and a side view, respectively, of the present invention installed on a commercial urinal.
Figure 4B:
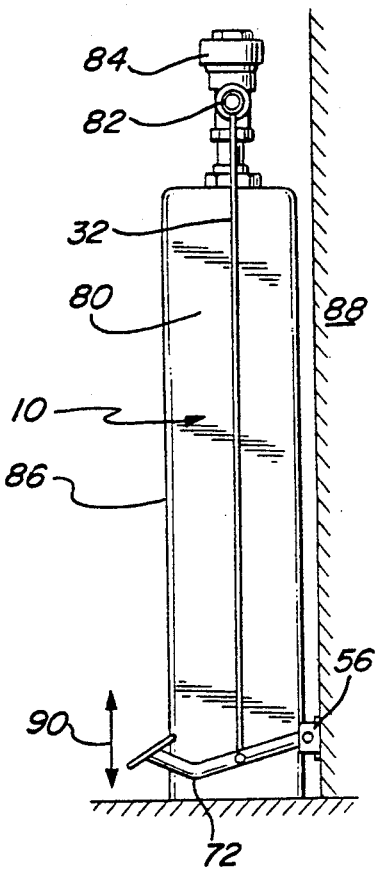

FIGS. 4*a* and 4*b* show the apparatus 10 installed on a full length commercial urinal 80. The extension tubing 12 is shown placed over a handle 82 of a flushing mechanism 84. The connecting rod 32 travels parallel to either side 86 of the urinal 80, depending upon the configuration of the flushing mechanism 84. The connecting rod 32 connects to the foot pedal 72 using the discussed method. The mounting bracket 56 is shown attached to a wall 88, to enable the foot pedal 72 to pivot about a vertical axis 90. The apparatus 10 operates as follows: When the foot pedal 72 is depressed by an operator, the foot pedal 72 pivots along the vertical axis 90, forcing the connecting rod 32 to oscillate along the vertical axis 90, which forces the extension tubing 12 to pivot downward, causing the handle 82 to actuate the flushing mechanism 84. When the foot pedal 72 is released, the handle 82 returns to its initial position, thus returning the foot pedal 72 to its initial position.

Figure 5:
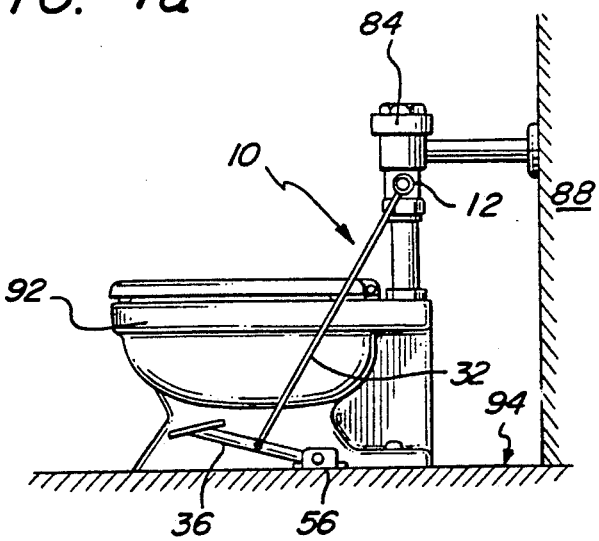
FIG. 5 shows the present invention installed on a commercial toilet.

FIG. 5 shows the apparatus 10 installed on a commercial toilet 92. The extension tubing 12 is shown placed over the handle 82 (not clearly seen in FIG. 5) of the flushing mechanism 84. The connecting rod 32 travels at an angle to the wall 88 toward a floor 94. The connecting rod 32 connects to the foot pedal 36 using the discussed method. The mounting bracket 56 is shown attached to the floor 94. In use, when the foot pedal 36 is depressed by an operator, the foot pedal 36 pivots towards the floor 94, forcing the connecting rod 32 to oscillate, which causes the extension tubing 12 to pivot downward, causing the handle 82 to actuate the flushing mechanism 84.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A device for adapting a hand actuation means of a latrine flushing mechanism to be actuated from a location on a surface remote therefrom, which comprises:

an adaptor means coupled to said actuation means and responsive to an actuation force for causing actuation of said actuation means;

a connecting means coupled to said adaptor means and responsive to oscillation for applying said actuation force to said adaptor means to actuate said actuation means;

a lever member coupled to said connecting means for oscillating said connecting means, said lever member comprising a straight portion of tubing having a tube of substantially smaller diameter and length affixed to an end thereof, said lever member having a substantially flat, rectangular plate having the flat portion thereof affixed to an end opposite of said smaller diameter tube, said plate forming a substantially acute angle with said portion of tubing; and a mounting means coupled to the smaller diameter tube affixed to said lever member for pivotally mounting said lever member to said remote surface, said mounting means comprising a substantially flat, rectangular mounting plate having a width substantially equal to the length of said smaller diameter tube, said mounting means including a pair of substantially flat, rectangular end plates affixed to the longest edges of said mounting plate, each end plate having an opening located at a centermost region thereof for pivotally affixing said lever member thereto, said mounting means having a torsion spring affixed between said smaller diameter tube and said end plates, said spring having an arced portion for exerting an upward force on the bottom portion of said lever member.

2. The device of claim 1 wherein the length of said end plates is less than the length of said mounting plate and said end plates are affixed by welding to the edges of said mounting plate at a centermost region thereof.

3. The device for adapting a hand actuation means of a latrine flushing mechanism of claim 2 wherein said oscillation is an oblique oscillation.

4. The device of claim 1 wherein said mounting plate has an opening located at each end region thereof for attachment thereof using attachment means to a remote surface.

5. The device of claim 4 wherein a fastening means is adapted to pass through said opening in one of said end plates and through said smaller diameter tube affixed to said lever member and through said opening in the distal end plate to pivotally mount said lever member to said mounting means.

6. The device of claim 1 wherein said connecting means comprises a substantially straight hollow rod member being tapped in either end and a pair of joining means, one of said joining means comprising a straight threaded bolt portion adapted to be retained in either tapped end of said rod member and an annular end portion having a rotatable ball bearing having a threaded bolt portion thereon for coupling to said adaptor means, a second joining means comprising a threaded bolt portion adapted to be retained in the remaining tapped end of said rod member and having an annular end portion for connecting said rod member to said lever member.

7. The device of claim 1 wherein a plurality of openings are disposed in the end region of said lever member proximal to the smaller diameter tube, one of said openings substantially oblong and disposed lengthwise in said lever member for receiving said connecting means and a pair of substantially round holes disposed opposite one another and substantially parallel to said smaller diameter tube, said holes located beneath a centermost region of said oblong opening for rotatably affixing said connecting means to said lever member.

8. The device of claim 7 wherein said lever member, said smaller diameter tube, and said plate are comprised of stainless steel.

9. The device of claim 8 wherein said smaller diameter tube and said plate are affixed to said lever member by welding.

10. A device for adapting a hand actuation means of a latrine flushing mechanism to be actuated from a location on a surface remote therefrom, which comprises:

an adaptor means coupled to said actuation means and responsive to an actuation force for causing actuation of said actuation means, said adaptor means comprising a straight portion of tubing having a flanged end with a slot disposed therethrough for slidable mounting thereof on said actuation means and an opposite end having a circular plate affixed thereto having a tapped opening in the center thereof, said flanged end having a tap screw disposed therein for securing said adaptor means to said actuation means;

a connecting means coupled to said adaptor means and responsive to oscillation for applying said actuation force to said adaptor means to actuate said actuation means;

a lever member coupled to said connecting means for oscillating said connecting means; and a mounting means coupled to said lever member for pivotally mounting said lever member to said remote surface.

11. The device of claim 10 wherein said connecting means comprises a substantially straight hollow rod member being tapped in either end and a pair of joining means, one of said joining means comprising a straight threaded bolt portion adapted to be retained in either tapped end of said rod member and an annular end portion having a rotatable ball bearing having a threaded bolt portion thereon for coupling to said adaptor means, a second joining means comprising a threaded bolt portion adapted to be retained in the remaining tapped end of said rod member and having an annular end portion for connecting said rod member to said lever member.

12. The device of claim 11 in which said rod member is substantially forty eight inches long.

13. The device of claim 11 in which said rod member is substantially twenty three inches long.

14. The device of claim 10 in which said adaptor means is comprised of stainless steel and is substantially three quarters inch in diameter and two and three sixteenths inches long.

15. A device for adapting a hand actuation means of a flushing mechanism to be actuated from a location on a surface remote therefrom comprising:

an adaptor means for coupling to said actuation means and responsive to an actuation force for causing actuation of said actuation means, said adaptor means comprising a straight elongated metallic tube having a flange end with a slot disposed lengthwise therethrough for slidable mounting thereof on said actuation means and having a circular plate affixed thereto having a tapped opening in the center thereof;

a connecting means coupled to said adaptor means and responsive to oscillation for applying said actuation force to said adaptor means to actuate said actuation means, said connecting means comprising a substantially straight hollow rod member having a tapped end region in either end and having a pair of joining means, one of said joining means comprising a straight threaded rod portion adapted to be retained in either tapped end of said rod member and an annular end portion having a rotatable ball bearing disposed therein, said ball bearing having a threaded rod portion thereon for coupling to said circular plate, a second joining means comprising a threaded rod portion adapted to be retained in the other of said tapped ends of said rod member and having an annular end portion;

a lever means coupled to said connecting means for oscillating said connecting means, said lever means comprising a straight elongated metallic tube having a substantially smaller straight tube of substantially smaller diameter and length affixed to an end thereof, said lever means having a flat rectangular plate affixed to an end opposite of said small diameter tubing with the narrowest side thereof parallel thereto, said plate forming a substantial angle with said lever means;

a mounting means coupled to said lever means for pivotally mounting said lever means to said surface, said mounting means comprising a flat, rectangular mounting plate for attachment thereof to a surface, the width thereof substantially equal to the length of said small diameter tubing, said mounting means having a pair of flat rectangular end plates affixed to edges thereof at a centermost region of the longest sides thereof, each of said end plates having an opening located at a centermost portion thereof; and a fastening means pivotally couples said lever means to said mounting means.

* * * * *